US007204795B2

(12) United States Patent
Himmen et al.

(10) Patent No.: US 7,204,795 B2
(45) Date of Patent: Apr. 17, 2007

(54) DEVIATION RING FOR A SELF-DISTRIBUTING CENTRIFUGE

(75) Inventors: Ernst-Ulrich Himmen, Odenthal (DE); Markus Longerich, Köln (DE); Jürgen Scholz, Leverkusen (DE); Detlef Freyer, Köln (DE); Ulrich Esser, Kürten (DE)

(73) Assignee: Westfalia Separator AG, Oelde (DE)

( * ) Notice: Subject to any disclaimer, the term of this patent is extended or adjusted under 35 U.S.C. 154(b) by 69 days.

(21) Appl. No.: 10/482,547

(22) PCT Filed: Jul. 8, 2002

(86) PCT No.: PCT/EP02/07563

§ 371 (c)(1),
(2), (4) Date: Dec. 30, 2003

(87) PCT Pub. No.: WO03/008105

PCT Pub. Date: Jan. 30, 2003

(65) Prior Publication Data

US 2004/0176233 A1 Sep. 9, 2004

(30) Foreign Application Priority Data

Jul. 19, 2001 (DE) ..... 101 35 317

(51) Int. Cl.
*B04B 7/04* (2006.01)
*B04B 15/02* (2006.01)

(52) U.S. Cl. ..... 494/14; 494/25; 494/60

(58) Field of Classification Search ..... 494/1–4, 494/12–14, 25, 43, 47–48, 56, 60–63, 67–73, 494/85; 210/360.1, 378
See application file for complete search history.

(56) References Cited

U.S. PATENT DOCUMENTS

| | | | | |
|---|---|---|---|---|
| 1,762,899 | A * | 6/1930 | Thomson et al. | 494/56 |
| 2,628,021 | A * | 2/1953 | Staaff | 494/35 |
| 2,723,799 | A * | 11/1955 | Sharples | 494/10 |
| 2,724,549 | A * | 11/1955 | Brown | 494/35 |
| 3,204,868 | A * | 9/1965 | Honeychurch | 494/35 |
| 3,799,431 | A * | 3/1974 | Lavanchy et al. | 494/35 |
| 3,981,437 | A * | 9/1976 | Hemfort et al. | 494/14 |

(Continued)

FOREIGN PATENT DOCUMENTS

DE 198 46 535 A1 4/2000

(Continued)

*Primary Examiner*—Charles E. Cooley
(74) *Attorney, Agent, or Firm*—Norris McLaughlin & Marcus PA

(57) ABSTRACT

The invention relates to a deviation ring for paste comprising an annular rebound wall (2) for a self-distributing centrifuge (1). The invention also relates to a corresponding self-distributing centrifuge (1). In the deviation ring, the angle of incidence ? of the tangents of the rebound wall (2) of the deviation ring (4), opposite the distribution slit (3) of the centrifuge (1), in relation to the horizontal, is between 3 and 60° over the entire opening width of the distribution slit (3).

15 Claims, 2 Drawing Sheets

U.S. PATENT DOCUMENTS

| | | | | | |
|---|---|---|---|---|---|
| 4,052,303 | A | * | 10/1977 | Hultsch et al. | 210/781 |
| 4,286,748 | A | * | 9/1981 | Bailey | 494/29 |
| 4,289,270 | A | * | 9/1981 | Warsinske | 494/27 |
| 4,325,825 | A | * | 4/1982 | Schutte | 210/371 |
| 5,269,849 | A | * | 12/1993 | Milner | 127/2 |
| 5,368,541 | A | | 11/1994 | Knelson | |
| 5,713,827 | A | * | 2/1998 | Errington | 494/56 |
| 5,788,621 | A | * | 8/1998 | Eady | 494/37 |
| 6,036,630 | A | * | 3/2000 | Robey | 494/22 |
| 6,325,751 | B1 | * | 12/2001 | Klintenstedt et al. | 494/60 |
| 6,398,706 | B1 | * | 6/2002 | Huang | 494/48 |
| 6,530,871 | B1 | | 3/2003 | Mackel et al. | |
| 7,074,173 | B2 | * | 7/2006 | Kohlstette et al. | 494/41 |
| 7,081,082 | B2 | * | 7/2006 | Scholz et al. | 494/37 |
| 2004/0176233 | A1 | * | 9/2004 | Himmen et al. | 494/14 |

FOREIGN PATENT DOCUMENTS

| | | | |
|---|---|---|---|
| EP | 0031549 | A1 * | 7/1981 |
| FR | 2 626 143 | | 7/1989 |
| WO | 92/11947 | * | 7/1992 |
| WO | WO 95/21697 | | 8/1995 |

* cited by examiner

DEVIATION RING FOR A SELF-DISTRIBUTING CENTRIFUGE

This is a 371 of PCT/EP02/07563 filed 8 Jul. 2002 (international filing date).

The invention relates to equipment for separating liquids and solids in centrifuges, in particular disk separators with automatic discharge. The invention relates in particular to a paste deflector ring with an annular impact wall for a self-discharging centrifuge and to the self-discharging centrifuge itself.

BACKGROUND OF THE INVENTION

Disk separators are centrifuges equipped with a central inlet for the suspension, conical disks which are located in the drum and which act as separators for fine particles as a result of the centrifugal force which is present and the short sedimentation paths. The particles which have been separated out slide along the disks into the solids collection space toward the maximum diameter of the drum. The clarified liquid is discharged over an overflow weir without pressure or under pressure by means of what is known as a gripper designed as a pump impeller.

For low solids contents, disk separators with a closed drum which have to be emptied by hand are in use. For higher solids contents, the drums are equipped with an emptying system which enables the entire contents of the drum comprising solids and liquid to be discharged as a slurry.

Disk separators with a standing or suspended drum are known.

German laid-open specification DE 198 46 535 A1 has disclosed a centrifuge with a suspended drum in which a tubular bag is fitted beneath the drum in order to collect the solid. The vessel in the centrifuge is of cylindrical design in the region of the centrifuging zone of the drum.

This has the drawback that the solids which are centrifuged out can remain stuck in the region of the centrifuging zone, making central collection of the solids impossible.

It is also known that with solid pastes with good flow properties, by achieving an extremely short drum opening time, what are known as partial sludge removal operations are possible, allowing a higher solids concentration to be achieved in the paste which is discharged.

In recent times, it has been attempted to produce a highly concentrated paste by extracting the liquid fraction in the drum before it is emptied and to discharge this highly concentrated paste through a controllable gap which is larger than has hitherto been customary.

For system reasons, the discharge of paste takes place with centrifugal acceleration in the horizontal direction onto a circular periphery, and the paste discharged could be collected in an annular vessel. However, it is desirable for the paste to be collected in a vessel located beneath the drum. This is preferably possible with a suspended drum in one embodiment of a centrifuge. The paste then has to be deflected from the horizontal direction downward into the vessel.

SUMMARY OF THE INVENTION

The invention relates to a device comprising a paste deflector ring and a paste container which is connected to it or can be released and is able to receive the paste from a plurality of drum emptying operations. This ring is designed in such a way that deflection entails the minimum possible product losses.

The subject matter of the invention is a paste deflector ring having an annular impact wall for a self-discharging centrifuge, characterized in that the setting angle $\alpha$ of the tangent of the impact wall of the deflector ring positioned opposite the discharge slot of the centrifuge with respect to the horizontal is from 3 to 60°, preferably 10 to 30°, as seen over the entire opening width of the discharge slot.

This allows gentle deflection, in particular with low shear forces, of the solid which has been centrifuged out of the discharge slot into the collection vessel of the centrifuge.

DETAILED DESCRIPTION

A particular deflector ring is characterized in that the inner contour of the impact wall immediately below the impact surface, in particular as seen over any desired longitudinal section through the deflector ring, is of circular or parabolic design.

This makes the deflection even more gentle on the product and further reduces the shear forces.

In a preferred form, the deflector ring is designed in such a way that the impact wall, in the region below the discharge slot, has a curved inner contour, as seen in geometric longitudinal section, with a radius of curvature of >20 mm, preferably of 30 to 50 mm.

The latter curved wall surface may also be designed according to a curve, with a radius which varies over the path length.

In a particularly preferred embodiment, the impact wall of the deflector ring, in the region above the opening width of the discharge slot, has a setting angle $\gamma$ with respect to the horizontal of 3 to 30°, preferably from 5 to 15°.

A preferred variant of the deflector ring is characterized in that the tangent of the inner contour of the impact surface, in the region below the deflecting contour of the deflector ring, has a setting angle $\beta$ of up to 30°, preferably from 5 to 15°, with respect to the vertical, as seen in geometric longitudinal section. The vertical is in this case parallel to the axis of rotation of the drum.

This results in particularly favorable guidance of the product which has been centrifuged out toward the center of the collection vessel.

In a preferred variant, the deflector ring has a detachment edge, which may be undercut, at its lower end.

The deflector ring is in particular integral with a collection vessel or is particularly preferably releasably connected to the collection vessel of the centrifuge.

In a preferred embodiment, the deflector ring is designed with jacket cooling.

The cooling jacket is, for example, a double wall on the outer periphery of the deflector ring, through which a heat-transfer medium can flow.

In a preferred embodiment, the surface of the deflector ring which comes into contact with product is provided with a coating with sliding properties, in particular made from PTFE or metal alloys.

In a further preferred variant, the deflector ring has one or more nozzles for spraying in liquid nitrogen.

These nozzles are in particular distributed over the periphery of the deflector ring below the impact surface which corresponds to the opening width of the discharge slot.

The subject matter of the invention is also a self-discharging centrifuge for the process engineering treatment of highly concentrated pastes, at least comprising an optionally coolable housing, a feed line for the suspension, a discharge line for the clarified liquid, a suspended drum, which is connected to a drive part at the top and has two or more discharge slots, a collection vessel, which if appropriate can be detached from the housing, and a discharge device for the paste, characterized in that the centrifuge includes a deflector ring according to the invention.

The collection vessel is preferably cylindrical or designed to taper conically toward the bottom.

The conical taper of the collection vessel makes it easier to discharge, for example, frozen product from the vessel. The upper edge of the vessel is in particular designed in such a way that a flow with little swirling is formed below the detachment edge which is preferably fitted as part of the deflector ring.

Likewise in a preferred embodiment, the inner surfaces of the collection vessel which come into contact with product are provided with a coating with sliding properties, in particular made from PTFE or metal alloys.

A bag made from flexible material is particularly preferably fitted into the collection vessel and can be fixed to the vessel walls in particular by means of a pressure reduction.

Suitable materials for the bag are all film plastics, in particular polypropylene, polyethylene or polyvinyl chloride.

In a preferred further form of the centrifuge, the collection vessel is designed with a temperature-control device, in particular with jacket cooling.

The collection vessel preferably also has means for transporting the collection vessel, in particular by means of floor conveyor devices.

The upper opening of the collection vessel is particularly preferably designed as a partial flange.

As a result, the collection vessel can, for example, be closed by means of a cover and is designed in such a way that it can be docked to other process engineering apparatus, in particular to a dissolving tank.

For use in the biotechnology sector, e.g. during the separation of pastes or clarification of liquids in human blood plasma fractionation, the collection vessel is designed with the capacity for jacket cooling.

To improve the cooling action, one or more nozzles may be fitted, through which liquid nitrogen can be introduced into the gas space in the vicinity of the rotating drum, in order to prevent the discharge space from being heated by air friction.

There are known disk separators which can be cleaned automatically by cleaning-in-place. For this purpose, during certain in some cases special operating states, the separator is rinsed with various cleaning liquids. Special CIP nozzles may be fitted to assist with the cleaning. When designing the components and the seals between the components, it should be ensured that they are readily accessible during the cleaning.

The vessel may be made from metallic or nonmetallic materials. The vessel may be arranged detachably or non-detachably in a frame which is transported or can be stacked by means of floor conveyor vehicles.

The vessel may be provided with a cover or may be equipped with an automatic opening slide and may be suitable for feeding dissolving tanks.

The vessel may be equipped with a slurrying or melting device which enables it to convey the contents into the dissolving tank as a free-flowing suspension.

Like the deflector ring, the vessel may also be equipped with the capacity for jacket cooling, for example for use in biotechnology.

The invention is explained in more detail below, by way of example, with reference to the figures, in which:

EXAMPLES

Figure 1:
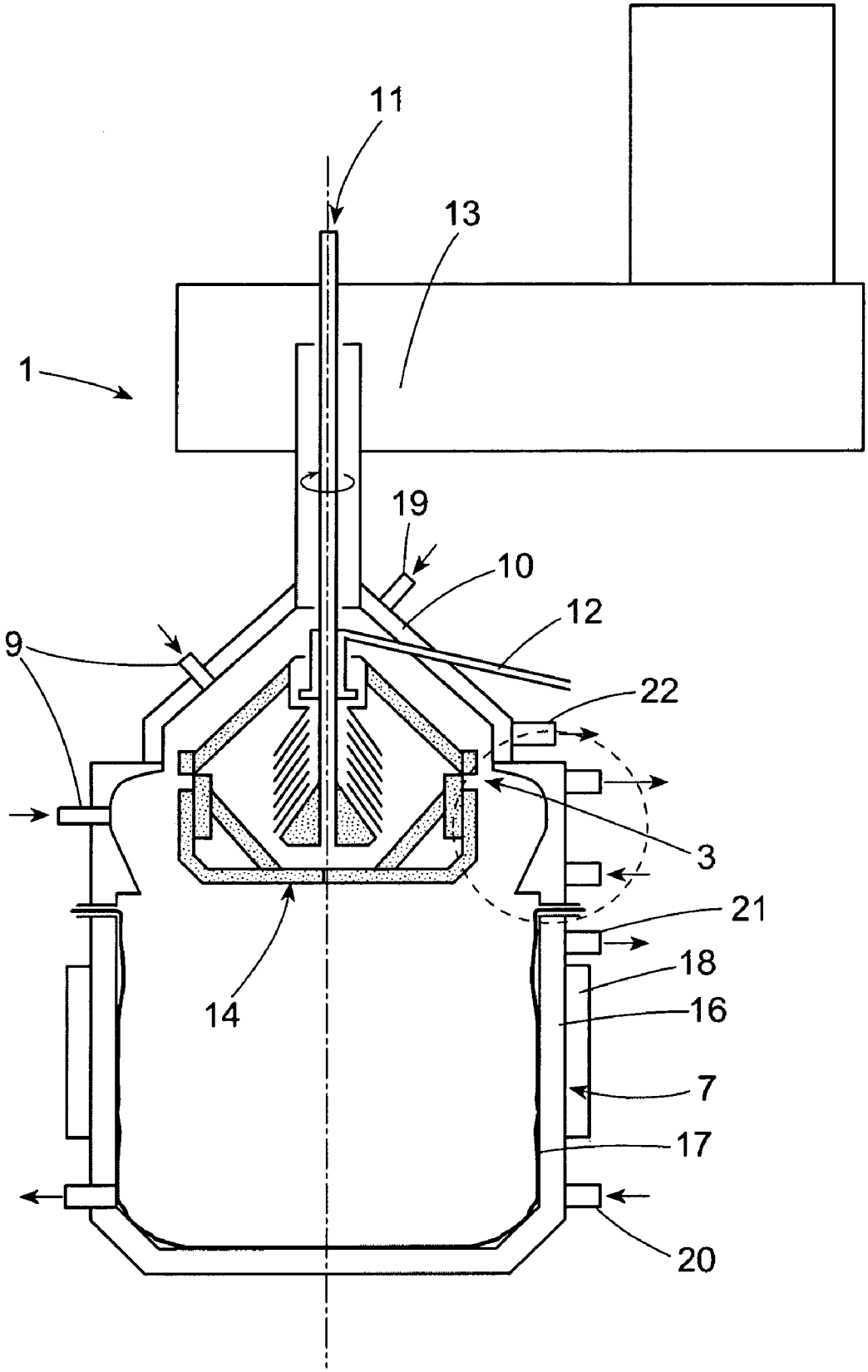
FIG. 1 shows a longitudinal section through a modified centrifuge 1.
Figure 2:
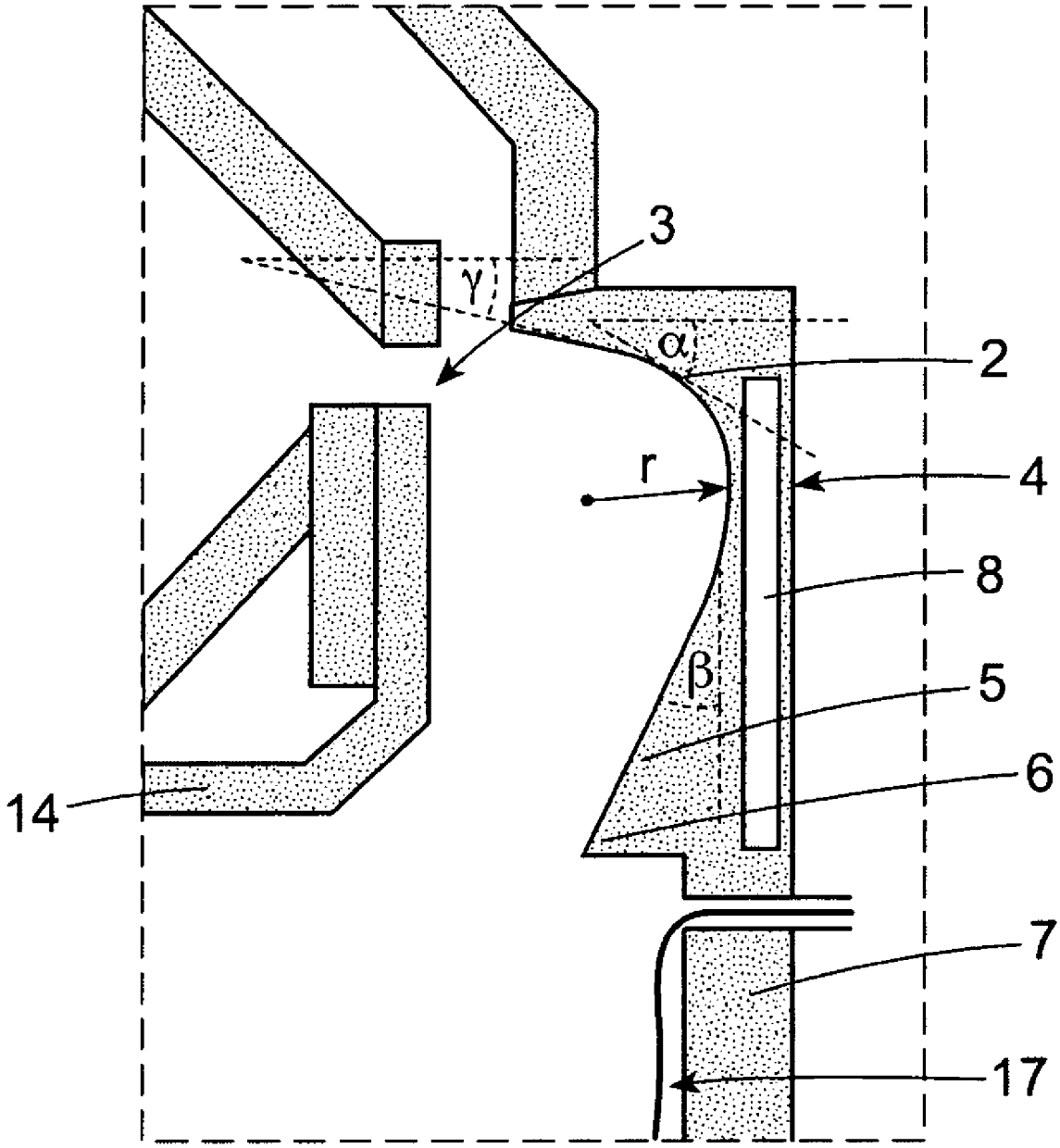
FIG. 2 shows an enlarged detail of the longitudinal section shown in FIG. 1.

The discharge of a biological paste which is formed during the fractionation of human blood plasma takes place from a centrifuge drum 14 having an external diameter of 468 mm at a drum rotational speed of 7000 rpm, with the blood plasma paste being deflected by a paste deflector ring 4. The centrifuge 1 has a drive part 13 for driving the drum 14, with a feed line 11 for the plasma. The drum 14 is suspended in a dividable lower part of the centrifuge 1 which comprises the jacket housing 10, with feed lines 19 and discharge lines 22 for a cooling liquid and lines 9 for introducing liquid nitrogen, the deflector ring 4 and the collection vessel 7, with flexible collection bag 17 inserted therein. The collection vessel has a cooling jacket 16 with feed lines 20 and discharge lines 21 and also welded-on transport brackets 18. The drum 14 also has an outlet 12 for the clarified liquid. FIG. 2 shows the deflector ring 4 in detail. The impact wall 2 of the paste deflector ring 4 is at an angle $\alpha=15°$ (cf. FIG. 2) with respect to the horizontal in the region of the discharge slot 3. The angle y above the opening width of the discharge slot 3 is likewise inclined by 15° with respect to the horizontal, so that the impact wall 2, itself and the region above it form a straight line in projection. Below the impact wall 2, the discharged paste is deflected toward the base of the collection vessel 7 by a circular contour, as seen in longitudinal section, with a radius of curvature r of 45 mm. To guide the discharged solids away from the vessel wall toward the center of the base, the adjoining surface 5 is inclined at an angle $\beta=10°$ with respect to the vertical. At its lower end, the paste deflector ring 4 has a detachment edge 6.

With this geometry, it was possible to achieve virtually complete deflection of the paste. By way of example, after two discharges from the centrifuge drum, 98.3% of the discharged mass of solids was located in the collection vessel 7 beneath it and only 1.7% was still on the surface of the deflector ring. A further test using a different biological paste, after six discharges, showed a mass of solids of 99.5% in the collection vessel, corresponding to a loss of 0.5% on the surface of the paste deflector ring.

We claim:

1. A self-discharging centrifuge (1) for the process engineering treatment of highly concentrated pastes, comprising at least a housing (10) that is optionally coolable, a feed line (11) for a suspension, a discharge line (12) for a clarified liquid, a suspended drum (14), which is connected to a drive part (13) at the top and has two or more discharge slots (3), and a collection vessel (7), wherein the centrifuge (1) includes a paste deflector ring having an annular impact wall (2) for the self-discharging centrifuge (1), said centrifuge having a discharge slot (3), wherein a setting angle $\alpha$ of the tangent of the impact wall (2) of the paste deflector ring (4) positioned opposite the discharge slot (3) of the centrifuge (1) with respect to the horizontal is from 3 to 60° as seen over the entire opening width of the discharge slot (3), said paste deflector ring having an inner contour immediately below the impact wall of circular or parabolic design and, in the region below said discharge slot (3) a curved inner contour with a radius of curvature (r) of>20 mm, said impact wall (2) having, in the region above the opening width of the discharge slot (3), a setting angle γ with respect to the horizontal of 3 to 30°, the tangent of the inner contour, in the region below the curved inner contour of the paste deflector ring having a setting angle β of up to 30°, with respect to the vertical, said paste deflector ring (4) having, at its lower end, a detachment edge (6) which optionally is undercut, said paste deflector ring (4) being integral with said collection vessel (7) or detachably connected to said collection vessel, said paste deflector ring being provided with a cooling jacket (8).

2. The centrifuge of claim 1, wherein a surface of the paste deflector ring which comes into contact with discharged product is provided with a coating with sliding properties.

3. The centrifuge as claimed in claim 2, wherein said coating with sliding properties is PTFE (polytetrafluoroethylene) or a metal alloy.

4. The centrifuge of claim 1, wherein the paste deflector ring has one or more nozzles (9) for spraying in liquid nitrogen.

5. The centrifuge as claimed in claim 1, wherein the collection vessel (7) is designed to be cylindrical or to taper conically toward the bottom.

6. The centrifuge as claimed in claim 1, wherein inner surface of the collection vessel (7) which come into contact with discharged product are provided with a coating with sliding properties.

7. The centrifuge as claimed in claim 1, wherein a bag (17) made from flexible material is inserted into the collection vessel (7) and optionally fixed to the vessel walls, optional by means of a pressure reduction.

8. The centrifuge as claimed in claim 1, wherein the collection vessel (7) is designed with a temperature-control device (16).

9. The centrifuge as claimed in claim 8, wherin said temperature-control device is a cooling jacket.

10. The centrifuge as claimed in claim 1, wherein the collection vessel (7) additionally has means (18) for transporting said collection vessel, in particular by means of floor conveyor devices.

11. The centrifuge as claimed in claim 1, wherein the collection vessel (7) has an upper opening formed as a partial flange.

12. The centrifuge as claimed in claim 1, wherein said setting angle a is from 10 to 30°.

13. The centrifuge as claimed in claim 1, wherein said radius of curvature (r) is 30 to 50 mm.

14. The centrifuge as claimed in claim 1, wherein said setting angle γ is 5 to 15°.

15. The centrifuge as claimed in claim 1, wherein said setting angle β is 5 to 15°.

* * * * *